United States Patent [19]

Ishikawa et al.

[11] Patent Number: 4,623,613

[45] Date of Patent: Nov. 18, 1986

[54] METHOD OF PROCESSING LIGHT-SENSITIVE SILVER HALIDE PHOTOGRAPHIC MATERIAL

[75] Inventors: Masao Ishikawa; Shigeharu Koboshi; Satoru Kuse, all of Hino, Japan

[73] Assignee: Konishiroku Photo Industry Co., Ltd., Tokyo, Japan

[21] Appl. No.: 810,413

[22] Filed: Dec. 18, 1985

[30] Foreign Application Priority Data

Dec. 25, 1984 [JP] Japan ..... 59-271963

[51] Int. Cl.[4] ..... G03C 5/24; G03C 7/40; G03C 11/00

[52] U.S. Cl. ..... 430/428; 430/372; 430/429; 430/432; 430/463

[58] Field of Search ..... 430/428, 429, 432, 463, 430/372

[56] References Cited

U.S. PATENT DOCUMENTS 4,294,911 10/1981 Guild ..... 430/429 X
4,336,324 6/1982 Koboshi et al. ..... 430/372
4,500,632 2/1985 Ohmura et al. ..... 430/428
4,520,096 5/1985 Endo et al. ..... 430/428 X
4,562,144 12/1985 Kurematsu et al. ..... 430/372

*Primary Examiner*—John E. Kittle
*Assistant Examiner*—Mukund J. Shah
*Attorney, Agent, or Firm*—Frishauf, Holtz, Goodman & Woodward

[57] ABSTRACT

In a method of processing a light-sensitive silver halide photographic material by processing the light-sensitive silver halide photographic material with a processing solution having fixing ability and subsequently processing it with a water washing-substitutive stabilizing solution substantially without carrying out water washing, the improvement wherein the concentration of a sulfite in said water washing-substitutive stabilizing solution is controlled to be $1.0\times10^{-5}$ mole/liter or more when the concentration of silver compounds in said water washing-substitutive stabilizing solution is from ½ to 1/1000-fold of the concentration of silver compounds in the preceding bath. According to the method of this invention, generation of sulfiding and mold or bacteria can be prevented, whereby dye images without drop out portion can be obtained.

12 Claims, No Drawings

METHOD OF PROCESSING LIGHT-SENSITIVE SILVER HALIDE PHOTOGRAPHIC MATERIAL

BACKGROUND OF THE INVENTION

This invention relates to a method of processing light-sensitive silver halide photographic materials, more particularly to a method of processing light-sensitive silver halide photographic materials which enables use of a stabilizing solution stably over a long term by controlling the sulfite ion concentration in the stabilizing solution.

Generally speaking, light-sensitive silver halide photographic materials subjected to imagewise exposure are processed according to various processing steps to form images thereon. For example, processing may be conducted following the steps of color developing—bleach-fixing—water washing or color developing—bleaching—fixing—water washing or developing—fixing—water washing.

Whereas, in recent years, for the purpose of conservation of environment, insurance of water resource or reduction in cost, there have been made various proposals to reduce washing water which has been employed in a large amount to a great extent. Above all, a multi-stage countercurrent stabilizing processing technique as disclosed in Japanese Unexamined Patent Publication No. 8543/1982 or a processing technique with the use of a stabilizing solution containing a bismuth complex as disclosed in Japanese Unexamined Patent Publication No. 134636/1983 has been known.

These processing techniques with stabilizing solutions may be appreciated as epoch-making methods in that the water washing processing step can be substantially obviated and further that stability of the dye image after processing can be increased.

Stabilizing processing is performed subsequent to the step using a processing solution having fixing ability such as a fixing solution or a bleach-fixing solution, and generally practiced in a plurality of tanks and according to the counter-current method, while supplementing a stabilizing solution from the final tank. Also, as different from the water washing processing step in which soluble residual matters are thoroughly washed away, stabilizing processing permits a certain amount of processing liquor components in the preceding bath to be brought about into the stabilizing processing step by the light-sensitive silver halide photographic material and accumulated therein. Of course, the amount of the stabilizing solution brought about by the light-sensitive silver halide photographic material is controlled in order to maintain the processing solution components in the preceding bath at a level within a certain range.

However, as mentioned above, as different from the water washing processing which removes thoroughly the soluble processing liquor components with a large amount of water, stabilizing processing will readily ensue various problems. For example, there may be involved generation of mold or scale due to prolonged residence time of the stabilizing solution, soluble silver complexes brought about by a processing solution having fixing ability (fixing solution or bleach-fixing solution), generation (sulfiding) of sulfur and silver sulfide due to decomposition of silver thiosulfate in most cases.

Above all, generation of sulfur or silver sulfide gives a vital damage to the dye image. For example, when sulfur or silver sulfide is formed in processing of a light-sensitive silver halide photographic material, particularly in the processing step of color nega, sulfur or silver sulfide will be incorporated into the gelatin on the surface of the light-sensitive silver halide photographic material, whereby serious problems in photographic performance may be caused such as loss of commercial value by frequent occurrence of so called white drop-out portions during printing, etc.

Accordingly, overcoming of the above problems must be said to be imminent and important in practical application of the stabilizing processing.

Heretofore, sulfites have frequently been used for preventing decomposition of thiosulfates or silver thiosulfate complexes in fixing solutions or bleach-fixing solutions, but it is also effective to use sulfites in stabilizing solutions for preventing decomposition of thiosulfates or silver thiosulfate complexes. As the method for incorporating a sulfite in a stabilizing solution, one may think of the method in which a large amount of a sulfite is incorporated in a processing solution such as fixing solution or bleach-fixing solution in the preceding bath brought about by the light-sensitive silver halide photograhic material or the method in which a sulfite is incorporated in the replenisher solution for the stabilizing solution.

However, in the case of the former method, since the fixing solution or bleach-fixing solution containing a sulfite brought about by the light-sensitive silver halide photographic material is generally diluted to ½–1/1000 fold in the case of the multi-stage countercurrent stabilizing processing, the sulfite concentration is lower as the processing bath is later, and therefore sulfiding will readily occur when the stabilizing solution resided over a long term. On the other hand, in the case of processing a small amount, because no sulfite is supplied into the stabilizing processing bath at all, the same problem as described above may be caused. Further, when a large amount of a sulfite is added to a bleach-fixing solution, the reduction reaction of an organic acid ferric complex with a sulfite occurs, resulting in problems such as formation of a leuco derivative or deterioration of desilverization.

On the other hand, in the latter case when a sulfite is incorporated in the replenisher solution for stabilizing solution, if the amount of the light-sensitive silver halide photographic material processed is small, the sulfurous acid will be deteriorated because the sulfite is little supplemented, whereby sulfiding occurs similarly as in the former case. On the contrary, if the days with large amount of processing continue and the sulfite is supplemented in an excessive amount to the stabilizing processing bath, there will be caused inconveniences such that mold or bacteria will be readily generated when the bath is left to stand for several days, etc.

Thus, it has been very difficult according to the method of the prior art to maintain and control over a long term a stabilizing solution which is effectively prevented from sulfiding and yet is small in generation of mold or bacteria.

As for bleach-fixing solution, a method for detecting sulfite ions is known, but this method cannot be easily practiced by anybody for detection of sulfite ions, but some steps are required to be operated following the operation procedures for detection of sulfite ions and operations must be done carefully.

SUMMARY OF THE INVENTION

Accordingly, an object of the present invention is to provide a method of processing light-sensitive silver halide photographic materials by use of a stabilizing solution which can prevent sulfiding over a long term and also is small in generation of mold or bacteria, whereby dye images without drop out portions can be obtained.

The present inventor has made intensive studies in order to overcome the above problems and consequently found that they can be accomplished by, in a method of processing a light-sensitive silver halide photographic material by processing the light-sensitive silver halide photographic material with a processing solution having the fixing ability and subsequently processing it with a water washing-substitutive stabilizing solution substantially without carrying out water washing, the improvement wherein a concentration of a sulfite in said water washing-substitutive stabilizing solution is controlled to be $1.0\times10^{-5}$ mole/liter or more, when a concentration of silver compounds in said water washing-substitutive stabilizing solution is $\frac{1}{2}$ to 1/1000-fold of the concentration of silver compounds in the preceding bath.

DETAILED DESCRIPTION OF PREFERRED EMBODIMENTS

In a preferable embodiment, a concentration of a sulfite in said water washing-substitutive stabilizing solutions detected by a simple analytical method, and the concentration thereof is controlled by supplemneting a replenisher solution in an amount corresponding to its shortage on the basis of the value deteced. In this case, the replenisher solution preferably contains a sulfite at a concentration of $1.0\times10^{-5}$ mole/liter. Further, it is particularly preferable in practicing the present invention to perform the above detection of the sulfite ion concentration by use of a test paper for simple analysis through the change in density or color.

The stabilizing processing in the present invention refers to a processing for stabilizing process which performs stabilizing processing immediately after processing with a fixing solution or a bleach-fixing solution substantially without carrying out water washing processing, and the processing solution to be used for said stabilizing processing is called the stabilizing solution and the bath or the tank using said stabilizing solution is called the stabilizing processing bath or the stabilizing processing tank. However, prior to the stabilizing processing of the present invention, rinsing or washing with a small amount of water may also be included, if desired.

The present invention is to be described in more detail below.

The method for detecting the sulfite ion concentration according to simple analytical method may include the method according to the precipitation method, the method according to coloration reaction, the method according to the decoloration reaction method, etc.

(1) As the method according to the precipitation method, the following methods may be included:
- (1 - 1) $Ba(NO_3)_2$ or $BaCl_2$ method
- (1 - 2) $Sr(NO_3)_2$ method
- (1 - 3) $Ca(NO_3)_2$ method
- (1 - 4) $Pb(CH_3COO)_2$ method
- (1 - 5) $AgNO_3$ method
- (1 - 6) $H_2O_2$ method
- (1 - 7) $Cl_2$, $Br_2$, $I_2$ method
- (1 - 8) $HgCl_2$ method
- (1 - 9) $SnCl_2$ method.

(2) As the method according to coloration reaction, the following methods may be included:
- (2 - 1) Method according to induced oxidation of $Co^{II}$+azide
- (2 - 2) Method according to induced oxidation of $Ni(OH)_2$
- (2 - 3) Sodium nitroprusside method
- (2 - 4) Zinc nitroprusside method
- (2 - 5) $Na(Fe(SO_4)_2$ method
- (2 - 6) Formalin method.

(3) As the method according to decoloration reaction, the following methods may be included:
- (3 - 1) Dye leuco formation method by utilizing reducibility of sulfite ions according to the fuchsin or malachite green method.

The method which can be particularly preferably employed as the method for detection of sulfite ions in a stabilizing solution of the present invention is the simple analytical method according to coloration and decoloration reaction.

Also, in practicing these simple analytical methods, the preferable method has a number of analytical steps as small as possible, preferably 2 steps or less in practicing the present invention.

The step as herein mentioned refers to the number of processing steps necessary for detection excluding the steps for collecting a sample solution. For example, when the sulfite ion concentration is to be detected by use of malachite green, the method in which a sample is collected, mixed with a buffer, and further the sulfite ion concentration is detected through decoloration by addition of malachite green comprises two steps. On the other hand, the method for confirming discoloration or decoloration of the test paper comprises one step, and is a particularly preferable method. In the present invention, when malachite green is used, a hue chart corresponding to sulfite ion concentrations, a certain amount of a buffer agent, a sample tube containing malachite green or a test paper and a pipette capable of collecting a constant amount of sample solution are prepared in advance, and it may be conceivable to employ the method in which the hue is observed by adding the stabilizing solution collected by the pipette in a sampling tube during measurement and the sulfite ion concentration is detected by corresponding to the hue chart (chromaticity chart); further the method in which a test paper incorporating a compound which is decolored or colored through the reaction with sulfite ions, is impregnated with a sample similarly as the above malachite green method, and the concentration is detected by corresponding the change in hue to the hue chart; or the method in which $Ba(NO_3)_2$, $BaCl_2$, etc. which will readily form precipitates through the reaction with sulfite ions are used and the concentration is detected from the amount precipitated. In the present invention, however, it is only sufficient to detect whether sulfite ions within a certain range are contained or not, whether they are normal or abnormal, instantly and simply, and it is not necessarily required to detect the sulfite ion concentration with good precision.

Thus, it is most preferred in practicing the present invention to employ a hue chart and a test paper for detection of sulfite ion which can instantly judge normality or abnormality.

When a test paper is used, the sulfite concentration is detected by coloration or decoloration. More specifically, the above compound capable of undergoing decoloration or coloration reaction is used by incorporating it in a test paper, and a commercially available sulfite test paper, for example, the test paper such as sulfite test paper produced by Merck Co. may also be used.

In the following, the method for making the test paper for sulfite ion detection of the present invention is to be described.

(1) $Na_2\{Fe(CN)_5NO\}$ $H_2O$ containing paper:

A baryta paper is impregnated with $Na_2\{Fe(CN)_5NO\}$ $H_2O$ and $ZnSO_4$ in amounts of 5.0 mg and 10.0 mg, respectively, per $cm^2$ of the paper, or coated with the dispersions of these compounds in gelatin so as to give the amounts as mentioned above to prepare a test paper.

This test paper indicates red color through the reaction with a sulfite.

(2) Malachite green containing test paper:

A test paper is prepared in the same manner as described above so that malachite green and hexyleneglycol may be contained in amounts of 4.0 mg and 80.0 mg, respectively, per $cm^2$ of the baryta paper.

This test paper is decolored with a sulfite in a weakly alkaline solution.

(3) Fuchsin containing test paper:

A test paper is prepared in the same manner as in the malachite green containing test except that fuchsin is used in place of malachite green.

This method is also decolored with a sulfite in a weakly alkaline solution, and therefore it is required to be used in combination with a buffer agent.

(4) Formalin method:

Since alkalinity is indicated by addition of formalin into a neutral solution, detection is effected with phenolphthalein by utilizing its alkalinity.

After a test paper is dipped in a sample solution maintained as a neutral solution and a phenolphthalein containing solution, it is immediately taken out and the concentration of a sulfite is detected by the change from colorless to red.

(5) Method according to induced oxidation of $Co^{II}$+azide:

When sodium azide $NaN_3$ is added to $Co^{II}$, a complex ion of violet color is formed. This is gradually changed by air oxidation to yellow $Co^{3+}$ azide complex ions, which is markedly promoted by the presence of $SO_3^{-2}$.

Accordingly, when to be used as a test paper, a test paper containing previously a $Co^{II}$ compound is prepared, and a sample is placed in a solution of $NaN_3$ and o-tolidine and detected with the test paper. In this case, through the effect of o-tolidine, the color is changed from violet to blue.

In the present invention, after detection of the sulfite ion concentration according to a simple analytical method, it is necessary to control the sulfite ion concentration on the basis of the value detected. As the method for controlling the sulfite concentration, there is the method in which the amount in shortage corresponding to the difference in the sulfite concentration detected by the simple analytical method and the sulfite concentration normally required is supplemented.

As the method for supplementation, it is preferable to supplement a sulfite as powdery or liquid agent singly or together with other additives. More preferably, it is supplemented as a liquid agent singly or together with other additives. In supplementing a sulfite, it may be supplemented in a necessary amount by use of a cup, etc. or alternatively as a replenisher solution by means of a supplementing device. Preferably, supplementation by means of a supplementing device either manually or automatically is simple and preferred.

The sulfite to be used in the present invention may include sodium sulfite, potassium sulfite, ammonium sulfite, ammonium bisulfite, potassium bisulfite, sodium bisulfite, potassium metabisulfite, ammonium metabisulfite, hydrosulfite, sodium acetaldehyde bisulfite, sodium propionaldehyde bisulfite, sodium butylaldehyde bisulfite, sodium succinaldehyde bisbisulfite, sodium glutaraldehyde bisbisulfite, sodium $\beta$-methylglutaraldehyde bisbisulfite, sodium maleindialdehyde bisbisulfite, sodium acetone bisulfite, sodium butanone bisulfite, sodium pentanone bissulfite, sodium 2,4-pentadione bisbisulfite and the like, by which the present invention is not limited, but any compound capable of releasing or forming a sulfite ion may be used.

The above sulfite should be added in the stabilizing solution in an amount preferably of $1.0\times10^{-5}$ mole/liter or more. That is, for example, when it is added as a replenisher solution, at least $1.0\times10^{-5}$ mole or more of a sulfite should be contained per one liter of the replenisher solution.

In the method for detecting the sulfite ion concentration of the present invention, it is preferred to detect the sulfite ion concentration in a stabilizing processing tank where the concentration of the silver compound in the stabilizing solution is $\frac{1}{2}$–1/1000 fold of the silver compound in the preceding bath, i.e., the fixing solution bath or bleach-fixing solution bath. A particularly preferable concentration range of the silver compound in the stabilizing solution is $\frac{1}{3}$–1/500 fold. That is, according to the investigations by the present inventors, it has been found that sulfiding will occur very readily and also mold or bacteria will be readily generated when the soluble silver complex in the fixing solution or bleach-fixing solution is within the range as stated above. When a fixing solution or a bleach-fixing solution is mixed in an amount in excess of $\frac{1}{2}$ relative to the stabilizing solution, sulfiding can occur with difficulty due to a large amount of a sulfite brought about by the light-sensitive silver halide photographic material from the preceding bath. Also, when the concentration is less than 1/1000, the soluble silver salt complex and soluble iron salt are extremely low in concentration, and sulfiding, if any, gives no practical problem. Accordingly, when controlling the sulfite ion concentration in a stabilizing solution, sulfiding of the stabilizing solution can be effectively prevented by controlling the sulfite concentration in the stabilizing solution when a concentration of silver compounds in said stabilizing solution is within the range of from $\frac{1}{2}$ to 1/1000 fold of the concentration of silver compounds in the preceding bath, i.e., a fixing solution bath or a bleach-fixing solution bath.

The stabilizing solution of the present invention can contain a compound capable of releasing hydrogen ions after processing.

The compound capable of releasing hydrogen ions after processing refers to a compound having an effect of lowering the pH value on the emulsion film surface after drying by 0.5 or more as compared with the pH value of the stabilizing solution by addition into the stabilizing solution. Specific substances may include ammoniom compound, methylamine, ethylamine, dimethylamine, trimethylamine, diethylamine, etc., compounds capable of releasing ions of these compounds and salts of these compounds. Among them, preferred is ammonium ion and an ammonium compound releasing ammonium ion in an aqueous solution. Specifically, there may be included ammonia, ammonium bromide, ammonium carbonate, ammonium hypophosphate, ammonium thiosulfate, ammonium sulfite, ammonium ethylenediaminetetraacetate, ammonium ferric diethylene-triaminepentaacetate, ammonium ferric ethylenediaminetetraacetate, ammonium diethylenetriaminepentaacetate, ammonium 1-hydroxyethylidene-1,1-diphosphonate, ammonium phosphate, ammonium phosphite, ammonium fluoride, acidic ammonium fluoride, ammonium fluoroborate, ammonium arsenate, ammonium hydrogen carbonate, ammonium hydrogen fluoride, ammonium hydrogen sulfate, ammonium sulfate, ammonium iodide, ammonium nitrate, ammonium pentaborate, ammonium acetate, ammonium adipate, ammonium laurintricarboxylate, ammonium benzoate, ammonium carbamate, ammonium citrate, ammonium diethyldithiocarbamate, ammonium formate, ammonium hydrogen malate, ammonium hydrogen oxalate, ammonium hydrogen phthalate, ammonium hydrogen tartarate, ammonium lactate, ammonium malate, ammonium maleate, ammonium oxalate, ammonium phthalate, ammonium picrate, ammonium pyrrolidinedithiocarbamate, ammonium salicylate, ammonium succinate, ammonium sulfamate, ammonium tartarate, ammonium thioglycolate, ammonium 2,4,6-trinitrophenol and so on.

Of the ammonium compounds, particularly preferred are ammonium thiosulfate, ammonia water (ammonium hydroxide), ammonium sulfate, ammonium chloride, ammonium nitrate, ammonium pentaborate, ammonium sulfamate, most preferably ammonium thiosulfate.

The amount of the compound capable of releasing hydrogen ions after processing added may preferably be $1.0\times10^{-5}$ or more, more preferably within the range of from 0.001 to 5.0 mole, further preferably within the range of from 0.002 to 1.0 mole, per one liter of the stabilizing solution.

The pH of the stabilizing solution to be used in the present invention is not particularly limited, but preferably within the range of from 2.0 to 9.5, further preferably from pH 4.0 to 9.0, particularly preferably from pH 6.0 to 9.0.

The pH controller which can be contained in the stabilizing solution of the present invention may be any one generally known as alkali agents or acid agents. The compound capable of releasing hydrogen ions after processing should preferably be capable of controlling the pH on the emulsion film surface of the light-sensitive silver halide photographic material after drying within the range of from 3.0 to 8.0 by varying the amount to be added depending on the pH value and buffering ability of the stabilizing solution, more preferably within the emulsion film surface pH of from 3.2 to 6.8, most preferably from 3.7 to 6.0.

The above pH on the emulsion film surface refers to the common logarithm of the reciprocal of the hydrogen ion molar concentration under the state where the dye containing layer of the light-sensitive silver halide photographic material is swelled with a slight amount of pure water, said pH being measured by a conventional pH meter with a glass electrode using a calomel electrode as the reference electrode. For measurement of the lowest surface coating pH with pure water, a flat type composite one electrode is generally employed.

Further, the stabilizing solution in the present invention can contain a chelating agent with a chelate stability constant of 8 or more relative to iron ions.

The chelate stability as mentioned herein means the constant as generally known from L. G. Sillen, A. E. Martell "Stability Constants of Metal-ion Complexes", The Chemical Society, London (1964); S. Chaberek, A. E. Martell, "Organic Sequestering Agents", Wiley (1959), etc.

The chelating agent, which has a chelate stability constant relative to iron ions of 8 or more and is to be preferably used in the stabilizing solution of the present invention may include organic carboxylic acid chelating agents, organic phosphoric acid chelating agents, inorganic phosphoric acid chelating agents, polyhydroxy compounds, etc. The above iron ions mean ferric ions ($Fe^{3+}$).

Typical examples of the compounds with a chelate stability constant with ferric ions of 8 or more may include the following compounds, which are not limitative of the present invention. That is, preferably employed are ethylenediamine di-o-hydroxyphenylacetic acid, diaminopropanetetraacetic acid, nitrilotriacetic acid, hydroxyethylenediaminetriacetic acid, dihydroxyethylglycine, ethylenediaminediacetic acid, ethylenediaminedipropionic acid, iminodiacetic acid, diethylenetriaminepentaacetic acid, hydroxyethyliminodiacetic acid, diaminopropanoltetraacetic acid, trans-cyclo-hexanediaminetetraacetic acid, glycoletherdiaminetetraacetic acid, ethylenediaminetetrakismethylenephosphonic acid, nitrilotrimethylenephosphonic acid, 1-hydroxyethylidene1,1'-diphosphonic acid, 1,1'-diphosphonoethane-2-carboxylic acid, 2-phosphonobutane-1,2,4-tricarboxylic acid, 1-hydroxy-1-phosphonopropane-1,2,3-tricarboxylic acid, catechol-3,5-diphosphonic acid, sodium pyrrolate, sodium tetrapolyphosphate, sodium hexametaphosphate, particularly preferably diethylenetriaminepentaacetic acid, nitrilotriacetic acid, 1-hydroxyethylidene-1,1'-diphosphonic acid or salts thereof. Further preferably, an ammonium salt thereof is used.

The above chelating agent may be used in an amount preferably of 0.01 to 50 g, more preferably 0.05 to 20 g, per one liter of the stabilizing solution.

Other compounds which can be added to the stabilizing solution may include organic acid salts (e.g. citric acid, acetic acid, succinic acid, oxalic acid, benzoic acid, etc.), pH buffer agents (phosphoric acid, boric acid salt, hydrochloric acid, sulfuric acid, etc.), antifungal agents (phenol derivatives, catechol derivatives, imidazole derivatives, triazole derivatives, thiabenzazole derivatives, organic halide compounds, and other antifungal agents known as slime controllers in paper-pulp industry), or sulfur agents, fluorescent brighteners, surfactants, preservatives, metal salts such as of Bi, Mg, Zn, Ni, Al, Sn, Ti, Zr, etc.

The processing temperature during stabilizing processing may preferably be 15° C. to 50° C., more preferably 20° C. to 45° C.

The method for feeding the stabilizing solution or the replenisher solution in the stabilizing processing according to the present invention should preferably be performed by feeding the solution through the later bath and permitting it to be overflowed from the preceding bath, when a multi-tank countercurrent system is employed. Also, as the method for adding the above sulfite or other compounds, they can be added as concentrated solutions into the stabilizing processing tank, or alternatively the above sulfite or other compounds and other additives may be added to the stabilizing solution to be fed into the stabilizing processing bath and used as the feed replenisher solution for the stabilizing solution, or any other addition method may be available.

The stabilizing processing bath in the present invention may be one, but desirably 2 to 3 tanks. More tanks may be used, but preferably 9 tanks or less.

The method for detecting the sulfite ion concentration in the present invention can be applied for any processing step, provided that it is a method for processing a light-sensitive silver halide photographic material having a stabilizing processing step.

In the following, specific processing steps are shown. However, the stabilizing processing is written merely as stabilizing. When two or more stabilizing processing tanks are employed, they are written as first stabilizing, second stabilizing, . . . .

(1) Color developing→Bleach-fixing→Small amount water washing→Stabilizing;
(2) Color developing→Bleach-fixing→Stabilizing;
(3) Color developing→Bleach-fixing→First stabilizing→Second stabilizing;
(4) Color developing→Water washing (or stabilizing)→Bleach-fixing→Stabilizing;
(5) Color developing→Stopping→Bleach-fixing→Stabilizing;
(6) Color developing→Bleaching→Water washing→Fixing→Water washing→Stabilizing;
(7) Color developing→Bleaching→Fixing→Water washing→Stabilizing;
(8) Color developing→Bleaching→Fixing→First stabilizing→Second stabilizing;
(9) Color developing→Bleaching→Small amount water washing→Fixing→Small amount water washing→Water washing→Stabilizing;
(10) Color developing→Small amount water washing→Bleaching→Small amount water washing→Fixing→Small amount water washing→Water washing→Stabilizing;
(11) Color developing→Stopping→Bleaching→Small amount water washing→Fixing→Small amount water washing→Water washing→Stabilizing;
(12) Black and white developing→Water washing (or stabilizing)→Reversal→Color developing→Bleaching→Fixing→Water washing (or omitted)→Stabililzing
(13) Pre-film hardening→Neutralization→Black and white developing→Stopping→Color developing→Bleaching→Fixing→Water washing (or omitted)→Stabilizing.

In these processing steps, if necessary, after the stabilizing processing step of the present invention, there may also be provided an auxiliary bath in which formalin or an activating agent is added for the purpose of stabilization of the image or film hardening.

In the following, a specific example of the controlling method of the present invention is to be described.

A representative example of the method for controlling the third tank in the stabilizing processing of the four-tank cascade countercurrent system in the color negative processing is as follows (measured once per week).

The sulfite concentration test paper produced by Merck Co. is lightly dipped in the third tank of the stabilizing processing tank, then taken out and left to stand for 30 seconds. Thereafter, by comparing the color of the test paper with a hue chart, the sulfite ion concentration in the stabilizing solution is measured. When red color is indicated, the sulfite is 0.5 g/liter or more and the processing can be continued. When pink color is indicated, the sulfite salt is about 0.005 g/liter, the processing can be continued but care must be taken. Next, in the case of colorless indication, the sulfite is approximately zero, and a countermeasure must be taken at once. As the countermeasure, a sulfite containing solution is supplemented manually or automatically, which is continued until the indication becomes pink to red with the above test paper. Generally, the amount of the sulfite added is determined depending on the tank volume, the concentration of sulfurous acid.

Next, a representative example of the method of controlling the stabilizing solution in color paper processing is as follows. In the case of this example, the stabilizing processing tanks are of the three-tank cascade countercurrent system, and the method for controlling the first tank of the stabilizing processing tank is shown.

A liquid sample is collected from the first tank of the stabilizing processing tank, and about 0.1 ml of the solution is taken therefrom into a test tube, the solution is added into a mixture cotaining previously 2.0 ml of 10% ammonium acetate solution and about 0.25 ml of 2% malachite green solution, and the sulfite ion concentration is determined by comparison of the hue of the mixture with the hue chart.

If the color is pink, the processing is continued. If it is reddish violet, the sulfite is slightly smaller in amount but the processing can be continued. Next, in the case of violet to bluish green, it indicates that the sulfite ion is small in amount. Accordingly, in this case, the sulfite is supplemented in the same manner as the above test paper, and the processing can be continued when the hue becomes pink to reddish violet.

The light-sensitive silver halide photographic material which can be processed by the stabilizing solution to which the controlling method of the present invention is applied may include all of various light-sensitive silver halide photographic materials. Such light-sensitive silver halide photographic materials may include, for example, light-sensitive materials for general black-and-white, light-sensitive materials for special black-and-white, light-sensitive materials for color, light-sensitive materials for printing, light-sensitive materials for X-ray, etc.

[EXAMPLES]

The present invention is described in more detail by referring to the following Examples, but the embodiments of the present invention are not limited thereto.

EXAMPLE 1

With respect to various concentrations of a soluble silver complex, effect of a sulfite on sulfiding was evaluated by employing a water washing-substitutive stabilizing solution having the following compositions, keeping the solution thus obtained in a constant temperature bath of 50° C., observing the external appearance of the solution and detecting the concentration of the sulfite.

Results ontained are shown in Table 1.

| (Water washing-substitutive stabilizing solution) | |
|---|---|
| Ethylene glycol | 1.0 g |
| 5-Chloro-2-methyl-4-isothiazolin-3-one | 1.0 g |
| 1-hydroxyethylidene-1,1-diphosphonic acid | 1.5 g |

-continued

| (Water washing-substitutive stabilizing solution) | |
|---|---|
| (60% solution) | |
| 2-Octyl-4-isothiazolin-3-one | 0.2 g |
| $BiCl_3$ (45% aqueous solution) | 0.15 g |
| Ammonia water (28% aqueous ammonium hydroxide solution) | 2.0 g |
| Bleach-fixing solution (described below) as shown in Table 1 | |

(made up with water to one liter, and adjusted to pH 7.8 with sulfuric acid or potassium hydroxide).

| (Bleach-fixing solution) | |
|---|---|
| Ferric ammonium ethylenediaminetetra-acetate dihydrate | 60 g |
| Ethylenediaminetetraacetic acid | 3 g |
| Ammonium thiosulfate (70% solution) | 100 ml |
| Ammonium sulfite (40% solution) | 25 ml |
| soluble silver complex (silver thiosulfate) as shown in Table 1 | |

(adjusted to pH 7.0 with ammonium hydroxide or glacial acetic acid, and made-up to total quantity of one liter with addition of water).

TABLE 1

| Sample No. | Silver thiosulfate (in terms of silver) | Proportion of bleach-fixing solution in stabilizing-solution | Days required for silver sulfide formation | Concentration of sulfite upon silver sulfide formation (mole/liter) |
|---|---|---|---|---|
| 1 | | 2/3 | >30 days | $3.0 \times 10^{-5}$ (30 days) |
| 2 | | 1/2 | 12 days | $0.95 \times 10^{-5}$ |
| 3 | | 1/3 | 7 days | $0.90 \times 10^{-5}$ |
| 4 | 30 g | 1/10 | 12 days | $0.98 \times 10^{-5}$ |
| 5 | | 1/100 | 20 days | $0.97 \times 10^{-5}$ |
| 6 | | 1/500 | 24 days | $0.95 \times 10^{-5}$ |
| 7 | | 1/1000 | 28 days | $0.96 \times 10^{-5}$ |
| 8 | | 1/5000 | >30 days | $0.68 \times 10^{-5}$ (30 days) |
| 9 | | 2/3 | >30 days | $4.5 \times 10^{-5}$ (30 days) |
| 10 | | 1/2 | 15 days | $0.96 \times 10^{-5}$ |
| 11 | | 1/3 | 9 days | $0.97 \times 10^{-5}$ |
| 12 | 5 g | 1/10 | 14 days | $0.99 \times 10^{-5}$ |
| 13 | | 1/100 | 23 days | $0.97 \times 10^{-5}$ |
| 14 | | 1/500 | 28 days | $0.98 \times 10^{-5}$ |
| 15 | | 1/1000 | >30 days | $1.05 \times 10^{-5}$ (30 days) |
| 16 | | 1/5000 | >30 days | $0.89 \times 10^{-5}$ (30 days) |
| 17 | | 2/3 | >30 days | $6.2 \times 10^{-5}$ (30 days) |
| 18 | | 1/2 | 18 days | $0.94 \times 10^{-5}$ |
| 19 | | 1/3 | 12 days | $0.98 \times 10^{-5}$ |
| 20 | 1 g | 1/10 | 18 days | $0.99 \times 10^{-5}$ |
| 21 | | 1/100 | 27 days | $0.98 \times 10^{-5}$ |
| 22 | | 1/500 | >30 days | $1.56 \times 10^{-5}$ (30 days) |
| 23 | | 1/1000 | >30 days | $1.21 \times 10^{-5}$ (30 days) |
| 24 | | 1/5000 | >30 days | $0.98 \times 10^{-5}$ (30 days) |

As is apparent from the results in Table 1, when the proportion of the bleach-fixing solution in the water washing-substitutive stabilizing solution is within the range of from ½ to 1/1000, silver sulfide is liable to be formed and its tendency is remarkably exhibited particularly when the silver concentration is high. When the concentration of the sulfite is $1.0\times10^{-5}$ mole/liter or less silver sulfide is formed, while when $1.0\times10^{-5}$ mole/liter or more formation of silver sulfide is prevented. Accordingly, the results indicates that formation of silver sulfide can be prevented by controlling the concentration of the sulfite to be a constant value of $1.0\times10^{-5}$ mole/liter or more, particularly when the proportion of the bleach-fixing solution in the water washing-substitutive stabilizing solution is within the range of from ½ to 1/1000.

EXAMPLE 2

With respect to various concentrations of a soluble silver complex, effect of a sulfite on sulfiding was evaluated in the same manner as in Example 1 except that the water washing-substitutive stabilizing solution used in Example 1 was replaced by a solution having the following compositions and the bleach-fixing solution used in Example 1 was replaced by a fixing solution having the following compositions.

As the concentration of the sulfite where silver sulfide was formed, the same value as in Example 1 was obtained. Although days required for formation of silver sulfide were remarkably prolonged, silver sulfide was easily formed when the proportion of the fixing solution in the water washing-substitutive stabilizing solution was in the range of from ½ to 1/1000, particularly from ⅓ to 1/500.

| (Water washing-substitutive stabilizing solution) | |
|---|---|
| Ethylene glycol | 1.0 g |
| 5-Chloro-2-methyl-4-isothiazolin-3-one | 1.0 g |
| 2-Octyl-4-isothiazolin-3-one | 0.2 g |
| (made up with water to one liter, and adjusted to pH with sulfuric acid or potassium hydroxide). | 7.0 |
| (Bleach-fixing solution) | |
| Ammonium thiosulfate | 150 g |
| Sodium bisulfite anhydride | 12 g |
| Sodium metabisulfite | 2.5 g |
| Disodium ethylenediaminetetraacetate | 0.5 g |
| Sodium carbonate | 10 g |
| soluble silver complex (silver thiosulfate) (in terms of silver) | 15 g |

(adjusted to pH 7.0 with ammonium hydroxide or glacial acetic acid, and made-up to total quantity of one liter with addition of water).

EXAMPLE 3

A polyethylene-coated paper support was coated successively from the support side with the respective layers as shown below to prepare a light-sensitive material.

First layer

A blue-sensitive silver halide emulsion layer comprising a silver chlorobromide emulsion containing 80 mole % of silver bromide, said emulsion containing 300 g of gelatin per 1 mole of silver halide; being sensitized with $3.0\times10^{-4}$ mole of a sensitizing dye (1) (with the use of isopropyl alcohol as the solvent) having the formula shown below per mole of the silver halide:

Sensitizing dye (1)

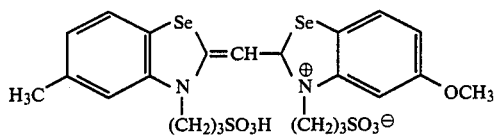

and containing 2,5-di-t-butylhydroquinone dispersed as a solution in dibutylphthalate and $2\times10^{-1}$ mole per mole of the silver halide of α-{4-(1-benzyl-2-phenyl-3,5-dioxo-1,2,4-triazolidyl)}-α-pivalyl-2-chloro-5-{γ-(2,4-di-t-amylphenoxy)butylamido)acetanilide as the yellow coupler, which emulsion is applied so as to give a silver quantity of 400 mg/m².

Second layer

A gelatin layer containing 150 mg/m² of di-t-octylhydroquinone dispersed as a solution in dibutylphthalate, 150 mg/m² of a mixture of 2-(2'-hydroxy-3',5'-di-t-butylphenyl)benzotriazole, 2-(2'-hydroxy-5'-t-butylphenyl)benzotriazole, 2-(2'-hydroxy-3'-t-butyl-5'-methylphenyl)-5-chlorobenzotri azole and 2-(2'-hydroxy-3',5'-di-t-butylphenyl)-5-chloro-benzotriazole (1:1:1:1) as the UV-ray absorber, which emulsion is applied so as to give a gelatin content of 2500 mg/m².

Third layer

A green-sensitive silver halide emulsion layer comprising a silver chlorobromide emulsion containing 70 mole % of silver bromide, said emulsion containing 500 g of gelatin per mole of the silver halide; being sensitized with $2.5\times10^{-4}$ mole of a sensitizing dye (2) having the formula shown below per mole of the silver halide:

Sensitizing dye (2)

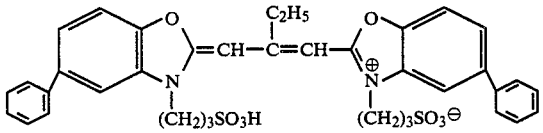

and containing 2,5-di-t-butylhydroquinone dissolved in a solvent comprising dibutylphthalate and tricresyl phosphate (3:1) and $1.5\times10^{-1}$ mole per mole of the silver halide of 1-(2,4,6-trichlorophenyl)-3-(2-chloro-5-octadecenylsuccinimidoanilino)-5-pyrazolone as the magenta coupler, which emulsion is applied so as to give a silver quantity of 370 mg/m². As the antioxidant, 0.2 mole of 2,2,4-trimethyl-6-lauryloxy-7-t-octylchroman was used per mole of the coupler.

Fourth layer

A gelatin layer containing 20 mg/m² of di-t-octylhydroquinone dispersed as a solution in dibutylphthalate, 400 mg/m² of a mixture of 2-(2'-hydroxy-3',5'-di-t-butylphenyl)benzotriazole, 2-(2'-hydroxy-5'-t-butylphenyl)benzotriazole, 2-(2'-hydroxy-3'-t-butyl-5'-methylphenyl)-5-chlorobenzotriazole and 2-(2'-hydroxy-3',5'-di-t-butylphenyl)-5-chloro-benzotriazole (1:1:1:1) as the UV-ray absorber, which emulsion is applied so as to give a gelatin content of 2500 mg/m².

Fifth layer

A red-sensitive silver halide emulsion layer comprising a silver chlorobromide emulsion containing 70 mole % of silver bromide, said emulsion containing 450 g of gelatin per mole of the silver halide; being sensitized with $2.5\times10^{-4}$ mole of a sensitizing dye (3) having the formula shown below per mole of the silver halide:

Sensitizing dye (3)

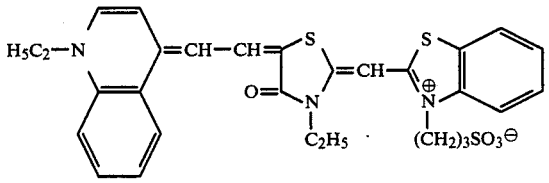

and containing 2,5-di-t-butylhydroquinone dispersed as a solution in dibutylphthalate and $3.0\times10^{-1}$ mole per mole of the silver halide of 2,4-dichloro-3-methyl-6-{γ-(2,4-diamylphenoxy)butylamido)phenol as the cyan coupler, which emulsion is applied so as to give a silver quantity of 350 mg/m².

Sixth layer

A gelatin layer applied so as to give a gelatin content of 900 mg/m².

The silver halide emulsions used in the respective light-sensitive emulsion layers (Layers 1, 3 and 5) were prepared according to the method as described in Japanese Patent Publication No. 7772/1971, each being chemically sensitized with the use of sodium thiosulfate pentahydrate, and 4-hydroxy-6-methyl-1,3,3a,7-tetrazaindene (2.5 g per mole of the siver halide) as the stabilizer, bis(vinylsulfonylmethyl)ether (10 mg per gram of gelatin) as the film hardener and saponin as the coating aid were incorporated in each emulsion.

After the color paper prepared according to the above method was exposed, continuous processings were carried out by use of the following processing steps and processing solution.

| [Processing steps] | | |
|---|---|---|
| (1) Color developing | 38° C. | 3 min. 30 sec. |
| (2) Bleach-fixing | 38° C. | 1 min. 30 sec. |
| (3) Stabilizing processing | 25–35° C. | 3 min. |
| (4) Drying | 65–75° C. | ca. 2 min. |

Processing solution compositions:

(Color developing tank solution)

| | |
|---|---|
| Benzyl alcohol | 15 ml |
| Ethylene glycol | 15 ml |
| Potassium sulfite | 2.0 g |
| Potassium bromide | 1.3 g |
| Sodium chloride | 0.2 g |
| Potassium carbonate | 24.0 g |
| 3-Methyl-4-amino-N—ethyl-N—(β-methanesulfonamidoethyl)-aniline sulfate | 4.5 g |
| Fluorescent whitening agent (4,4'-diaminostilbendisulfonic acid derivative, Trade name: Kaycoll PK-conc, manufactured by Shinnisso Kako Co. Ltd.) | 1.0 g |
| Hydroxylamine sulfate | 3.0 g |
| 1-Hydroxyethylidene-1,1-diphosphonic acid | 0.4 g |
| Hydroxyethyliminodiacetic acid | 5.0 g |
| Magnesium chloride hexahydrate | 0.7 g |
| 1,2-dihydroxybenzene-3,5-disulfonic acid disodium salt | 0.2 g |
| (made up to total quantity of one liter with | |

-continued

| | |
|---|---|
| addition of water and adjusted to pH 10.20 with KOH or $H_2SO_4$). | |
| (Color developing replenisher solution) | |
| Benzyl alcohol | 20.0 ml |
| Ethylene glycol | 20.0 ml |
| Potassium sulfite | 3.0 g |
| Potassium carbonate | 30.0 g |
| Hydroxylamine sulfate | 4.0 g |
| 3-Methyl-4-amino-N—ethyl-N—(β-methane-sulfonamidoethyl)aniline sulfate | 6.0 g |
| Fluorescent whitening agent (4,4'-diaminostilbendisulfonic acid derivative, Trade name: Kaycoll PK-conc, manufactured by Shinnisso Kako Co. Ltd.) | 2.5 g |
| 1-Hydroxyethylidene-1,1-diphosphonic acid | 0.5 g |
| Hydroxyethyliminodiacetic acid | 5.0 g |
| Magnesium chloride hexahydrate | 0.8 g |
| 1,2-dihydroxybenzene-3,5-disulfonic acid disodium salt | 0.3 g |
| (made up to total quantity of one liter with addition of water and adjusted to pH 10.70 with KOH). | |
| (Bleach-fixing tank solution) | |
| Ferric ammonium ethylenediaminetetra-acetate dihydrate | 60 g |
| Ethylenediaminetetraacetic acid | 3 g |
| Ammonium thiosulfate (70% solution) | 100 ml |
| Ammonium sulfite (40% solution) | 27.5 ml |
| (adjusted to pH 7.1 with potassium carbonate or glacial acetic acid, and made-up to total quantity of one liter with addition of water). | |
| (Bleach-fixing replenisher solution A) | |
| Ferric ammonium ethylenediaminetetra-acetate dihydrate | 260 g |
| Potassium carbonate | 42 g |
| (made up to total quantity of one liter with addition of water; pH of this solution is 6.7 ± 0.1). | |
| (Bleach-fixing replenisher solution B) | |
| Ammonium thiosulfate (70% solution) | 500 ml |
| Ammonium sulfite (40% solution) | 250 ml |
| Ethylenediaminetetraacetic acid | 17 g |
| Glacial acetic acid | 85 ml |
| (made up to total quantity of one liter; pH of this solution is 5.3 ± 0.1). | |
| (Water washing-substitutive stabilizing tank solution and replenisher solution) | |
| Ethylene glycol | 1.0 g |
| 1-Hydroxyethylidene-1,1-disulfonic acid (60% aqueous solution) | 1.0 g |
| Aqueous ammonia solution (aqueous 25% ammonium hydroxide solution | 2.0 g |
| (made up to one liter with water and adjusted to pH 7.0 with sulfuric acid. | |

An automatic processing machine was supplied in full with the above color developing tank solution, the bleach-fixing tank solution and the water washing-substitutive stabilizing tank solution, and running test was carried out for the above color paper subjected to processing while supplementing the color developing replenisher solution, the bleach-fixing replenisher solutions A and B as described above and water washing-substitutive replenisher stabilizing solution through quantitating cups at intervals of 3 minutes. The amounts supplemented per 1 $m^2$ of the color paper were 190 ml to the color developing tank, each 25 ml of the bleach-fixing replenisher solutions A and B to the bleach-fixing tank and 250 ml of the water washing-substitutive replenisher stabilizing solution to the stabilizing tank, respectively.

The stabilizing processing tanks in the automatic processing machine were assembled in a multi-stage countercurrent system, in which the first to the third tanks were arranged in the direction of the flow of the light-sensitive material, supplement being done through the third tank, with the overflow from the third tank being permitted to be flowed into the previous tank and further the overflowed liquor being permitted to be flowed into the further previous tank. However, amount of the bleach-fixing solution brought into the water washing-substitutive stabilizing solution was controlled by use of a squeeze roller in order to examine the effect of the proportion of the bleach-fixing solution in the stabilizing solution.

Continuous processing was performed until the total amount of the water washing-substitutive stabilizing solution became 3-fold of the total volume of the stabilizing tanks (hereinafter referred to as "running processing amount") and then the external appearance of the solution was observed. Results thus obtained are shown in Table 2.

TABLE 2

| Sample No. | Days required for running processing amount | Stabilizing tank | Proportion of bleach-fixing solution in stabilizing solution | Presence of silver sulfide formation | Concentration of sulfite upon silver sulfide formation |
|---|---|---|---|---|---|
| 25 | 90 days | the first tank | ½ | no sulfiding | *$5.0 \times 10^{-5}$ |
| 26 | | | 1/5 | sulfiding | $0.98 \times 10^{-5}$ |
| 27 | | the second tank | 1/30 | sulfiding | $0.93 \times 10^{-5}$ |
| 28 | | | 1/90 | sulfiding | $0.97 \times 10^{-5}$ |
| 29 | | the third tank | 1/300 | sulfiding | $0.98 \times 10^{-5}$ |
| 30 | | | 1/1200 | no sulfiding | *$0.75 \times 10^{-5}$ |
| 31 | 150 days | the first tank | ½ | sulfiding | $0.95 \times 10^{-5}$ |
| 32 | | | 1/5 | sulfiding | $0.97 \times 10^{-5}$ |
| 33 | | the second tank | 1/30 | sulfiding | $0.96 \times 10^{-5}$ |
| 34 | | | 1/90 | sulfiding | $0.98 \times 10^{-5}$ |
| 35 | | the third tank | 1/300 | sulfiding | $0.95 \times 10^{-5}$ |
| 36 | | | 1/1200 | no sulfiding | *$0.65 \times 10^{-5}$ |

*Concentration of sulfite upon completion of running

As is apparent from Table 2, when running processing was effected, silver sulfide was formed in the first tank to the third tank. Silver sulfide was easily formed particularly when days required for the running processing amount are long and the concentration of the sulfite is $1.0 \times 10^{-5}$ mole/liter or less. However, when the proportion of the bleach-fixing solution in the water washing-substitutive stabilizing solution is 1/1200, no sulfiding occured although days required for the running processing amount are long and and the concentration of the sulfite is $1.0 \times 10^{-5}$ mole/liter or less.

EXAMPLE 4

Under the same conditions as in Example 3 in which days required for the running processing amount are 150 days, running processing was done while controlling the proportions of the bleach-fixing solution in the first to the third tank and the concentration of the sulfite in the first tank as indicated in Table 3. The concentration of the sulfite in the first stabilizing tank was measured once two days by use of the sulfite test paper (produced by Merck Co.) and running tests were continued, the sulfite was supplemented in an amount corresponding to the shortage based on the result detected.

TABLE 3

| Stabilizing solution | Proportion of bleach-fixing solution in stabilizing solution | Concentration of ammonium sulfite (g/liter) |
|---|---|---|
| the first tank | 1/8 | 0.5 |
| the second tank | 1/90 | 0.5 |
| the third tank | 1/500 | 0.5 |

The resuls obtained showed that no sulfiding was observed when running processing was continued for up to 150 days.

EXAMPLE 5

The storability of the solution was examined by adjusting the pH of the water washing-substitutive stabilizing solution used in Example 4 to be pH 2.0, 4.0, 6.0, 9.0 and 11.0 with sulfuric acid or potassium hydroxide. No silver sulfide was generated when pH of the solution was 6.0 or more and the lapsing days were 30 days. However, when the pH was 4.0, stains were generated on light-sensitive color materials processed.

EXAMPLE 6

A hue chart for detection of sulfite ion concentration was prepared by use of the sulfite test paper (produced by Merck Co.).

As the sulfite, ammonium sulfite was used and added in amounts of 0 mg, 10 mg, 50 mg, 125 mg and 500 mg per one liter of the stabilizing solution. Further, in the above solutions, the sulfite test paper (produced by Merck Co.) was lightly dipped, then taken out, left to stand for 30 seconds and dried. The hue chart obtained is as shown in Table 4.

| [Stabilizing solution] | |
|---|---|
| 5-Chloro-2-methyl-4-isothiazolin-3-one | 0.02 g |
| 2-Methyl-4-isothiazolin-3-one | 0.02 g |
| Ethylene glycol | 1.0 g |
| 2-Octyl-4-isothiazolin-3-one | 0.01 g |
| Ammonium 1-hydroxyethylidene-1,1-diphosphonate (40% solution) | 3.0 g |
| $BiCl_3$ | 0.65 g |
| $MgSO_4.7H_2O$ | 0.2 g |
| Ammonia water (25% aqueous ammonium hydroxide solution) | 2.5 g |
| (made up with water to one liter, and adjusted to pH with sulfuric acid). | 7.0 |

TABLE 4

| Amount of $(NH_4)_2SO_3$ added (mg/liter of stabilizing solution) | Hue chart |
|---|---|
| 0 | Colorless |
| 10 | Pale pink |
| 50 | Pink |
| 125 | Deep pink |
| 500 | Copper |

On the basis of this hue chart, the sulfite ion concentration of the stablizing solution (three-tant cascade countercurrent system) was measured in a camera shop where a color papaer automatic processing machine CL-RP500 (produced by Konishiroku Photo Industry Co.) was employed. Measurement was conducted for the first to the third tanks. As Control, reference was made to the values determined by the iodine titration method. The results are shown in Table 5.

TABLE 5

| | First tank | Second tank | Third tank |
|---|---|---|---|
| Sulfite ion concentration detected from sulfite test paper | 500 mg (Copper) | 125 mg (deep pink) | 50 mg (pink) |
| Sulfite ion concentration determined by the iodine titration method | 480 mg | 115 mg | 45 mg |

As apparently seen from Table 5, it can be appreciated that the method by use of the sulfite test paper according to the present invention gives the results of detection with good precision. Moreover, detection could be done within a short time of about 30 seconds by the method using the sulfite test paper.

EXAMPLE 7

The experimenter went to the camera shop where the sulfite ion concentration was measured in Example 6, and measured again the sulfite ion concentration in the stabilizing solution in the first tank with the use of the sulfite test paper. The results are shown in Table 6.

TABLE 6

| | Hue in the first tank | |
|---|---|---|
| | Sulfite test paper method | Iodine titration method |
| On the first day | Copper | 480 mg |
| Three weeks later | Pink | 45 mg |

As shown above, three weeks later, the sulfite concentration in the first tank was considerably deteriorated as compared with that on the first day (within the range where no sulfiding occurred yet), and therefore 435 mg of ammonium sulfite corresponding in amount to the shortage from that on the first day was added, and the sulfite concentration was again measured with the sulfite test paper. The results are shown in Table 7.

TABLE 7

| | Hue in the first tank | |
|---|---|---|
| | Sulfite test paper method | Iodine titration method |
| After addition of ammonium sulfite corresponding to shortage | Copper | 485 mg |

As shown in Table 7, even when the sulfite corresponding to shortage is added, detection with the sulfite test paper of the present invention is effected with good precision similar to that of the Control iodine titration method. Thus, according to the present invention, it can be understood that the sulfite concentration can be detected before it becomes that at which sulfiding may occur, whereby sulfiding can be prevented. The time required for completion of the operations from detection of the sulfite ion to the counter measure applied as described above was about 1 minute and 30 seconds.

We claim:

1. In a method of processing a light-sensitive silver halide photographic material by processing the light-sensitive silver halide photographic material with a processing solution having fixing ability and subsequently processing it with a water washing-substitutive stabilizing solution substantially without carrying out water washing, the improvement wherein the concentration of a sulfite in said water washing-substitutive stabilizing solution is controlled to be $1.0\times10^{-5}$ mole/-liter or more when the concentration of silver compounds in said water washing-substitutive stabilizing solution is from ½ to 1/1000-fold of the concentration of silver compounds in the preceding bath.

2. The method of processing a light-sensitive silver halide photographic material according to claim 1, wherein the concentration of a sulfite in said water washing-substitutive stabilizing solution is controlled to be $1.0\times10^{-5}$ mole/liter or more when the concentration of silver compounds in said water washing-substitutive stabilizing solution is from ⅓ to 1/500-fold of the concentration of silver compounds in the preceding bath.

3. The method of processing a light-sensitive silver halide photographic material according to claim 1, wherein said water washing-substitutive stabilizing solution contains a compound capable of releasing hydrogen ions after processing.

4. The method of processing a light-sensitive silver halide photographic material according to claim 3, wherein the compound capable of releasing hydrogen ions is selected from the group consisting of an ammonium compound, methylamine, ethylamine, dimethylamine, trimethylamine, diethylamine, compounds capable of releasing ions of these compounds and salts of these compounds.

5. The method of processing a light-sensitive silver halide photographic material according to claim 4, wherein the compound capable of releasing hydrogen ions is an ammonium compound capable of releasing ammonium ions.

6. The method of processing a light-sensitive silver halide photographic material according to claim 3, wherein the compound capable of releasing hydrogen ions is added in an amount of $1.0\times10^{-5}$ mole or more per one liter of the water washing-substitutive stabilizing solution.

7. The method of processing a light-sensitive silver halide photographic material according to claim 6, wherein the compound capable of releasing hydrogen ions is added in an amount of from 0.001 to 5.0 mole per one liter of the water washing-substitutive stabilizing solution.

8. The method of processing a light-sensitive silver halide photographic material according to claim 7, wherein the compound capable of releasing hydrogen ions is added in an amount of from 0.002 to 1.0 mole per one liter of the water washing-substitutive stabilizing solution.

9. The method of processing a light-sensitive silver halide photographic material according to claim 1, wherein the water washing-substitutive stabilizing solution has a pH of from 2.0 to 9.5.

10. The method of processing a light-sensitive silver halide photographic material according to claim 9, wherein the water washing-substitutive stabilizing solution has a pH of from 4.0 to 9.0.

11. The method of processing a light-sensitive silver halide photographic material according to claim 10, wherein the water washing-substitutive stabilizing solution has a pH of from 6.0 to 9.0.

12. The method of processing a light-sensitive silver halide photographic material according to claim 11, wherein processing with the water washing-substitutive stabilizing solution is carried out at a temperature of from 15° to 50° C.

* * * * *